US008408196B2

(12) United States Patent
Jacklich et al.

(10) Patent No.: US 8,408,196 B2
(45) Date of Patent: Apr. 2, 2013

(54) CEILING SUPPORT BOX WITH OUTSIDE AIR INLET

(75) Inventors: John R. Jacklich, Napa, CA (US); Eric Adair, Dixon, CA (US)

(73) Assignee: M&G DuraVent, Inc., Vacaville, CA (US)

( * ) Notice: Subject to any disclaimer, the term of this patent is extended or adjusted under 35 U.S.C. 154(b) by 487 days.

(21) Appl. No.: 12/605,985

(22) Filed: Oct. 26, 2009

(65) Prior Publication Data

US 2010/0108052 A1 May 6, 2010

Related U.S. Application Data

(63) Continuation-in-part of application No. 11/743,065, filed on May 1, 2007, now Pat. No. 7,665,457, and a continuation-in-part of application No. 12/544,996, filed on Aug. 20, 2009.

(51) Int. Cl.
*F24C 1/14* (2006.01)
*F24C 3/00* (2006.01)

(52) U.S. Cl. ..... 126/80; 126/84; 126/94; 126/21 R; 126/15 R; 126/316; 454/45

(58) Field of Classification Search ..... 126/80, 126/84, 94, 85 B, 21 R; 454/252
See application file for complete search history.

(56) References Cited

U.S. PATENT DOCUMENTS

| | | | | |
|---|---|---|---|---|
| 2,755,794 | A | 7/1956 | Wendell | |
| 3,688,681 | A * | 9/1972 | Iversen et al. | 454/252 |
| 5,282,456 | A | 2/1994 | Smelcer et al. | |
| 5,311,930 | A | 5/1994 | Bruenn | |
| 5,399,119 | A | 3/1995 | Birk et al. | |
| 5,562,088 | A | 10/1996 | Valters et al. | |
| 5,715,808 | A | 2/1998 | Wilhoite | |
| 6,039,041 | A * | 3/2000 | Barth | 126/85 B |
| 6,053,162 | A * | 4/2000 | Godfree et al. | 126/85 B |
| 6,109,339 | A | 8/2000 | Talbert et al. | |
| 6,295,981 | B1 * | 10/2001 | Beal et al. | 126/512 |
| 6,647,977 | B2 | 11/2003 | Lesage | |
| 6,848,720 | B2 | 2/2005 | Carns et al. | |
| 6,971,682 | B2 * | 12/2005 | Hoang et al. | 285/93 |
| 2007/0221195 | A1 * | 9/2007 | Bibaud et al. | 126/80 |

OTHER PUBLICATIONS

Notice of Allowance dated Mar. 28, 2012, U.S. Appl. No. 12/544,996, filed Aug. 20, 2009.

* cited by examiner

*Primary Examiner* — Steven B McAllister
*Assistant Examiner* — Nikhil Mashruwala
(74) *Attorney, Agent, or Firm* — Vierra Magen Marcus LLP

(57) ABSTRACT

A ceiling support box is an interface for coupling two sections of pipe as part of a venting apparatus for a heating appliance. Dual functionality is provided in a single integrated device by having a vent path for exhausting combustion by-products, and a separate air inlet path to draw in combustion air for use by the heating appliance.

12 Claims, 15 Drawing Sheets

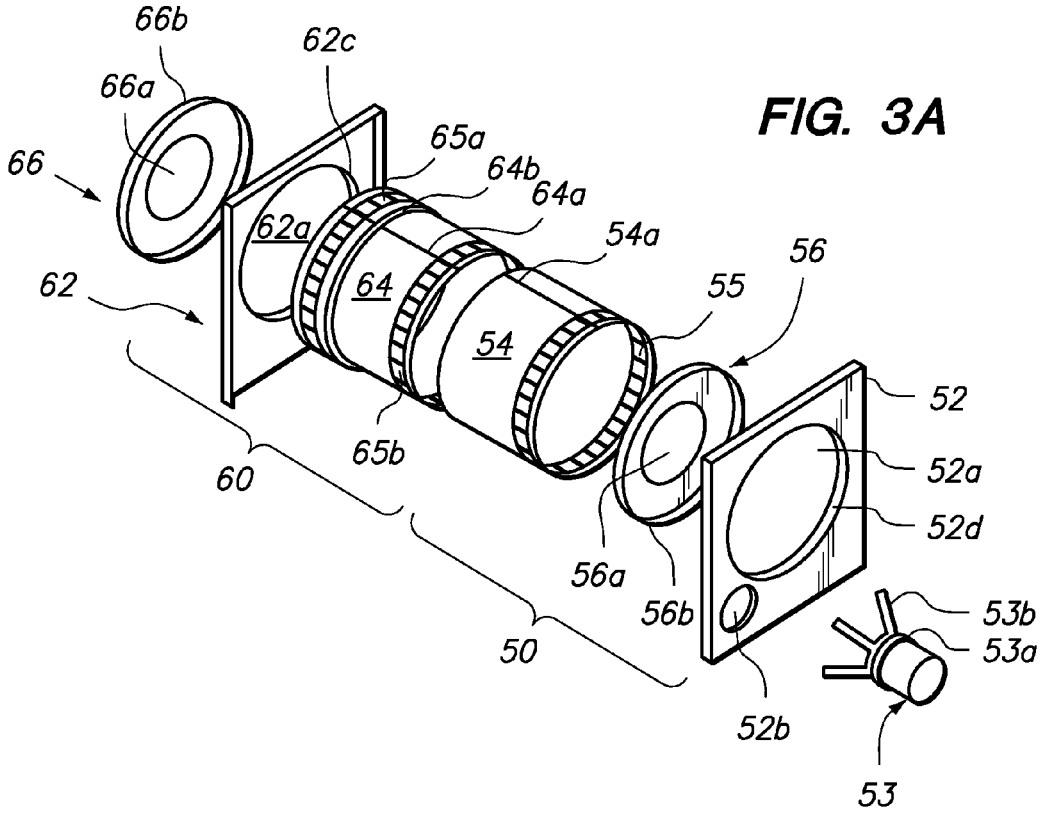
FIG. 3A
FIG. 3B
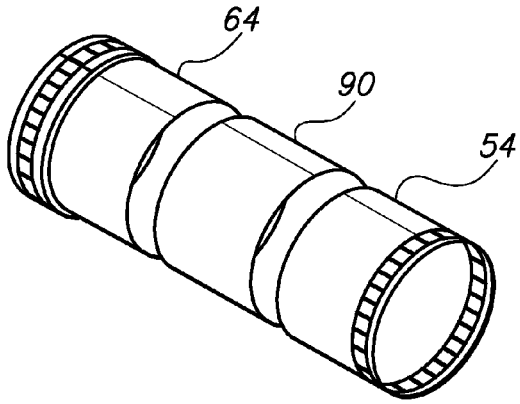

CEILING SUPPORT BOX WITH OUTSIDE AIR INLET

CROSS-REFERENCE

This application is a continuation-in-part of application Ser. No. 11/743,065 and application Ser. No. 12/544,996.

TECHNICAL FIELD

The present disclosure is directed to heating appliance interface devices for through-the-wall and through-the ceiling installations, which are useful to provide a routing path to run piping for venting combustion by-products from a heating appliance and for providing combustion air to the heating appliance.

BACKGROUND

Fuel-burning appliances, including wood stoves and pellet stoves, require an exhaust system in order to vent combustion by-products, such as noxious gases, fine ash, and water vapor, to the outside of the structure containing the appliance. In addition, combustion air must be supplied to the appliance to properly fuel the fire. In a typical pellet stove installation, the appliance includes a mechanical fan to both blow the combustion by-products out through the exhaust pipe and to draw combustion air in through a separate air inlet pipe, while wood-burning appliances do not have a fan and are naturally drafting. However, it is also typical to create two different openings in the wall or ceiling adjacent to the heating appliance, one for routing the exhaust outlet, and one for routing the combustion air inlet.

It would be desirable to have a single component that provides two paths—one for the exhaust outflow, and one for the combustion air inflow, such that only a single opening in the wall or ceiling is required.

BRIEF DESCRIPTION OF THE DRAWINGS

FIG. 3A is an exploded perspective view of the wall thimble shown in FIGS. 1 and 2.

FIG. 3B is an alternative embodiment of a portion of the wall thimble shown in FIG. 3A.

DETAILED DESCRIPTION

The present disclosure is directed to a wall or ceiling interface device for a heating appliance and a method of using the same. When used through a wall, the device is commonly referred to as a "thimble" or "wall thimble," and when used through the ceiling, the device is commonly referred to as a ceiling support or support box. Advantageously, the structures described herein provide dual functionality in a single device by having a vent path for exhausting combustion by-products, and a separate air inlet path to draw in outside combustion air for use by the heating appliance. It should be recognized that the description is not intended to be limiting with respect to the features or application of the dual function device, which are readily applicable to all types of heating appliances.

Figure 1:
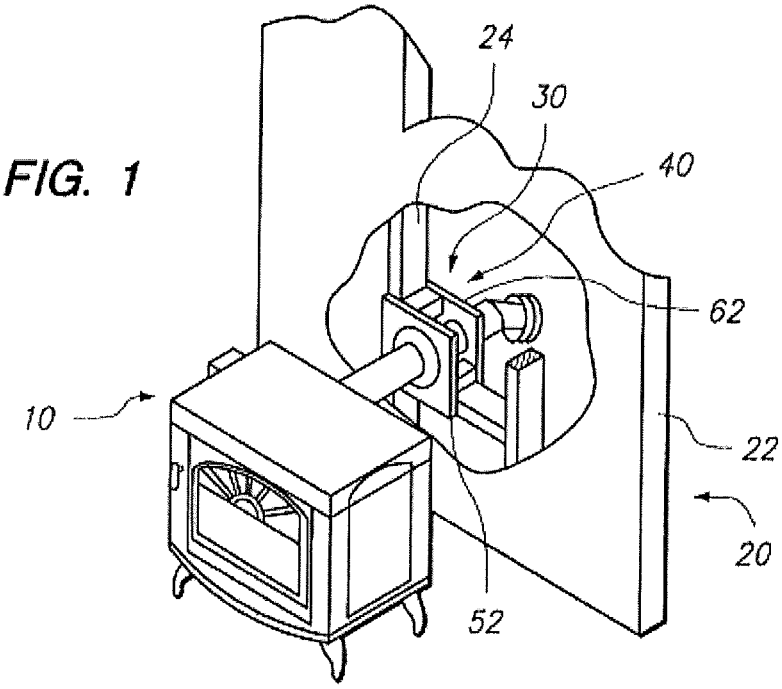
FIG. 1 is a perspective view of one embodiment of a typical pellet stove installation including an exhaust/intake system.
Figure 2:
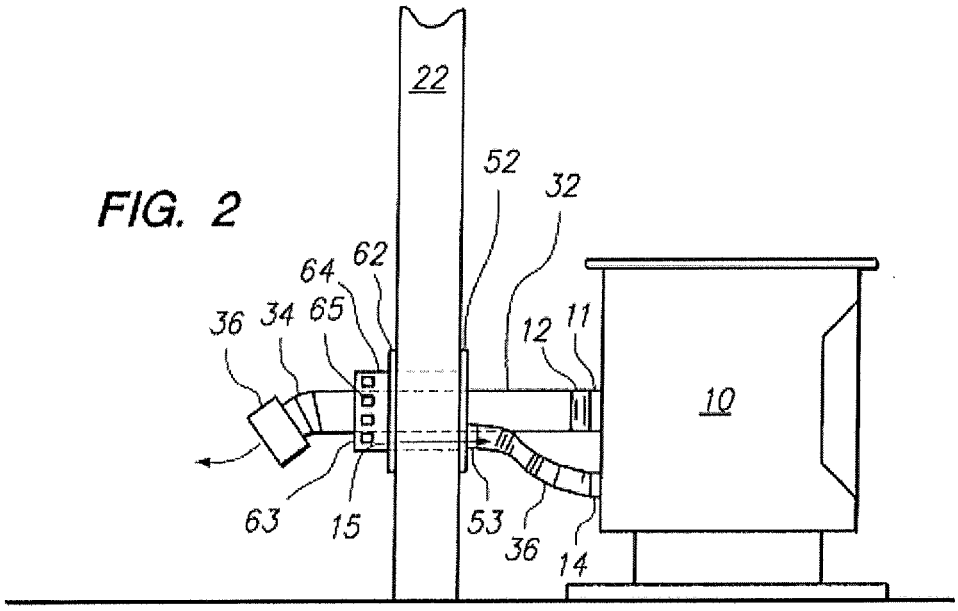
FIG. 2 is a side plan view through section 2-2 of FIG. 1.

Referring now to FIGS. 1-2, one embodiment of a stove 10 and a corresponding exhaust/intake system 30 is illustrated. The stove 10 may be a pellet stove or any other heating appliance, including a gas-fired stove, wood-burning stove, or corn-burning stove. The stove 10 is installed on the inside of structure 20 near an exterior wall 22. Typical clearance is three inches minimum from the wall, although applicable building codes and industry practices should be followed.

The illustrated exhaust/intake system 30 provides horizontal venting through an opening in exterior wall 22, although alternative venting techniques could be used and will be readily apparent to workers in this field. The exhaust/intake system 30 may be fabricated using standard sheet metal materials with conventional bending and fastening techniques.

The exhaust/intake system 30 includes a vent pipe 32 which is coupled to the exhaust outlet 11 of stove 10 (shown in FIG. 2), and which extends through a thimble 40, which is mounted in wall 22, to the exterior of structure 20. Proper venting is critical to combustion performance, and local building codes and manufacturers' installation instructions typically require that a vent pipe for heating appliances be specifically tested and listed by Underwriters Laboratories ("UL") or other ANSI recognized test facility for use with the appliance. For example, type PL vent pipe, tested to UL 641, is listed for use with pellet stoves, and is commonly available in 3 inch and 4 inch diameter pipe. Type PL vent pipe is a double-walled cylindrical pipe, wherein the stainless steel inner pipe carries the exhaust products and is separated from the outer wall by an air space. For stoves that require PL vent pipe, substitute venting materials should not be used unless such materials are approved by the manufacturer and/or local building codes.

In one embodiment of pipe 32, the inner flue is formed using 0.012 inch type 430 stainless steel, and the outer wall is formed using 0.018 inch galvalume steel to provide heat and corrosion resistance. A one-quarter inch annular air space is provided between the inner and outer walls to provide for static air insulation and to ensure safe outer wall temperatures, while also providing a minimum clearance to nearby combustibles. To prevent fly ash leakage, each pipe joint is sealed, for example, with a silicone O-ring gasket. In addition, all elbows, tees, and fittings are sealed with a liberal amount of room-temperature-vulcanizing ("RTV") silicone.

The thimble 40 provides an inside/outside interface and is mounted in an opening specially formed in the exterior wall 22 to accommodate the exhaust/intake system 30. The thimble 40 includes an inside plate 52 that is mounted to the wall 22 on the inside of structure 20, and an outside plate 62 that is mounted to the wall 22 on the outside of structure 20. For example, the inside plate 52 and outside plate 62 may be rigidly affixed to structural members 24 of wall 22.

The side view shown in FIG. 2 shows more clearly the inside/outside transition of the exhaust/intake system 30 through wall 22. The stove 10 has an exhaust outlet 11 and includes an adaptor 12, which may be separate from the stove 10 in some embodiments, coupled to the exhaust outlet. A section of exhaust pipe 32 is coupled to the stove 10 via the adaptor 12. The inside plate 52 and the outside plate 62 are mounted to the wall 22, as noted above, to rigidly fix the thimble 40 in place. The exhaust pipe 32 is routed through the thimble 40 into an elbow 34, and terminated into a round horizontal cap 36. Typically, the terminus of the exhaust pipe 32 should extend at least 12 inches from the exterior wall 22.

Figure 4:
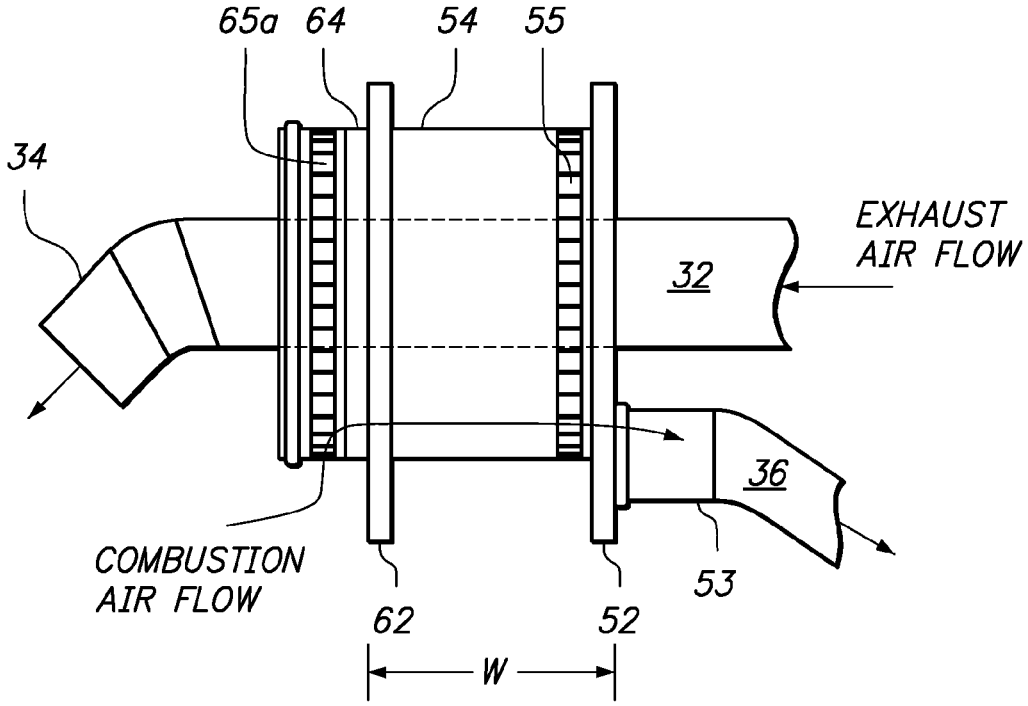
FIG. 4 is a magnified side plan view of a portion of FIG. 3A.

As better shown in FIGS. 3-4, the thimble 40 includes an inner band 64 that is rigidly affixed to the outside plate 62, and sized to fit snugly inside of outer band 54, as described more fully below. The inner band 64 includes a distal portion 63 that extends from the outside plate 62 and wall 22 approximately two inches. A plurality of vent openings 65 are formed on the distal portion 63 of inner band 64. A short inlet pipe 53 is coupled to an opening **52*b* (shown in FIG. 3A) on the inside plate 52, and an inlet air tube 36 is coupled to the inlet pipe and to the combustion air inlet 14 of stove 10. Thus, advantageously, the thimble construction allows outside air to be drawn in through vent openings 65 and directed through the inlet air tube 36 to the combustion air inlet 14 of stove 10, as shown by arrow 15. The thimble 40 includes a housing having two main portions that mate with each other, namely an inside housing portion 50 and an outside housing portion 60, and that are each formed as a separate, integral assembly. Advantageously, when the thimble 40 is mounted into a suitable opening in wall 22, the outside housing portion 60 fits within inside housing portion 50. More specifically, the inner band 64 is sized to fit within outer band 54. Further, the length of housing portions 50 and 60 is sufficient to allow the total thickness W of the thimble to be adjusted during field installation to accommodate for differences in wall thicknesses. For example, in one construction, the housing portions allow the thimble thickness W to be adjustable between approximately 5.75 to 8.00 inches. In another construction, shown in FIG. 3B, an extension piece 90 can be provided and coupled in the field between housing portions 54 and 64**. All pipe couplings are sealed and gasketed in the field upon installation.

The inside housing portion 50 includes inside plate 52, inlet pipe 53, outer band 54, and inlet cap 56. In one embodiment, the inside plate 52 measures approximately 11 inches wide by 11 inches tall, and includes a first opening **52*a* and a second opening 52*b*. The first opening 52*a* is centrally located at approximately 5 inches from the top and 4.5 inches from the sides of plate 52, and measures approximately 6.964 inches in diameter. The second opening 52*b* is located in one corner of the plate 52, and is centered at approximately 1.985 inches from the bottom of plate and 2.165 inches from the side of the plate, and measures approximately 2.000 inches in diameter. The outside edges 52*c* of the plate 52 are folded back at a right angle approximately one-half inch or less on all four sides, and a circular flange 52*d* of similar dimension is formed inside of opening 52*a*. The inside plate 52** is formed from 0.018 inch galvanized steel plate or other suitable material.

The inlet pipe 53 is formed from 0.018 inch type 304 stainless steel, which provides excellent corrosion resistance, or other suitable material. The length of inlet pipe 53 is approximately 2 inches, and it is cold-rolled into a cylinder measuring approximately 2.000 inches in effective diameter (adequate to fit within opening **52*b*), then riveted and spot welded to maintain the cylinder shape. A roll bead 53*a* is formed near one end of the inlet pipe 53, and that end of the inlet pipe after the roll bead is cut into tabs 53*b*. The inlet pipe 53 is inserted into opening 52*b* until stopped by the roll bead 53*b*. At least some of the tabs 53*b* are then folded over and spot welded to the inside of inside plate 52**, for example, with four resistance welds are that applied at 90 degrees spacing.

The outer band 54 is 0.018 inch zinc-plated galvanized steel plate or other suitable material, and is cold-rolled into a generally cylindrical, hollow section then riveted or welded at the seam **54*a* to maintain the shape. The outer band 54 has an outside diameter of approximately 7.000 inches and a length of approximately 5 inches. A plurality of vent openings 55 are formed approximately three-quarters inch from the end of outer band 54 proximate to inside plate 52. The vent openings 55 are approximately one-half inch square, and cover the entire circumference around band 54**, but in some embodiments could cover only a portion of the circumference, for example one-quarter or one-half. Further, the number and size of the vent openings can be changed as desired or based on empirical studies of combustion air flow.

The inlet cap 56 is 0.018 inch zinc-plated galvanized steel plate or other suitable material, and is formed into a circular piece measuring approximately 6.964 inches in diameter, and having an opening **56*a* measuring approximately 3.750 inches in diameter, and a right angle flange 56*b*** of approximately one-half inch depth.

The inside housing portion 50 is assembled together by coupling the inlet cap 56 and outer band 54 to the inside plate 52. This is done by fitting the flange **56*b* of inlet cap 56 over the flange 52*d* of inside plate 52, then fitting the end of outer band 54** over both sets of flanges, then pop riveting these components together, for example, with four rivets spaced at 90 degrees.

The outside housing portion 60 includes outside plate 62, inner band 64, and outlet cap 66. The outside plate 62 measures approximately 11 inches wide by 11 inches tall, and includes an opening 62*a*. The opening 62*a* is centrally located at approximately 5 inches from the top and 4.5 inches from the sides of outside plate 62, and measures approximately 7.000 inches in diameter. The outside edges 62*b* of outside plate 62 are folded back at a right angle approximately one-half inch or less on all four sides, and a circular flange 62*c* of similar dimension is formed to the outside of opening 62*a*. The outside plate 62 is formed from 0.018 inch galvanized steel plate or other suitable material.

The inner band 64 is 0.018 inch zinc-plated galvanized steel plate or other suitable material, and is cold-rolled into a generally cylindrical, hollow section then riveted or welded at the seam 64*a* to maintain the shape. The inner band 64 has an outside diameter of approximately 6.964 inches and a length of approximately 5 inches. A plurality of vent openings 65*a* are formed near one end of inner band 64. The vent openings 65*a* are each approximately one-half inch square, and cover the entire circumference around inner band 64, but in some embodiments could cover only a portion of the circumference. Also, the number and size of the vent openings could be adjusted. A roll bead 64*b* is formed on inner band 64 approximately 1½ inches from the end nearest outside plate 62.

The outlet cap 66 is 0.018 inch zinc-plated galvanized steel plate or other suitable material, and is formed into a circular piece measuring approximately 6.964 inches in diameter, and having an opening 66*a* measuring approximately 3.750 inches in diameter, and a right angle flange 66*b*.

The outside housing portion 60 is assembled together by coupling the outlet cap 66 and inner band 64 to the outside plate 62. The inner band 64 is fit through opening 62*a* in outside plate 62 until stopped by roll bead 64*b*, at which point the end of the inner band extends beyond the outside plate 62 by approximately 1½ inches such that openings 65*a* are exposed outside of exterior wall 22. The flange 62*c* of outside plate 62 is attached to the inner band 64 using 6 resistance welds spaced at 60 degrees. The flange 66*b* of outlet cap 66 is fit over the end of inner band 64, and corresponding roll beads (not shown) are formed, then resistance welds are applied, for example, at 90 degrees spacing.

The inside housing portion 50 and outside housing portion 60 are pre-assembled, then are fitted together during field installation and securely attached to wall 22. The slight difference in diameters of the outer band 54 and the inner band 64 allows the inner band to be inserted into the outer band, as previously noted. Thus, as shown in FIG. 4, the outer band 54 including vent openings 55 overlies the inner band 64 between the inside plate 52 and the outside plate 62. However, because inner band 64 extends beyond the plane of outside plate 62 to the outside, vent openings 65*a* of inner band 64 are exposed. Thus, variations in wall thicknesses can be accommodated by changing how far the inner band 64 is inserted into the outer band 54. In addition, the outer band 54 and inner band 64 may be rotated relative to each other during installation as desired to achieve an optimum placement of the thimble components.

Finally, exhaust pipe 32 is fitted through the openings 56*a* and 66*a* in inlet cap 56 and outlet cap 66, respectively, and coupled to exhaust outlet 11 on the stove and to terminus elbow 34 outside the exterior wall. Thus, the exhaust pipe 32 provides an inside passageway in thimble 40 for carrying exhaust by-products to the exterior of the structure, while at the same time creating an annulus or outside passageway between the pipe and the bands 54, 64 for carrying combustion air from the outside to the appliance combustion air inlet 14.

Figure 5A:
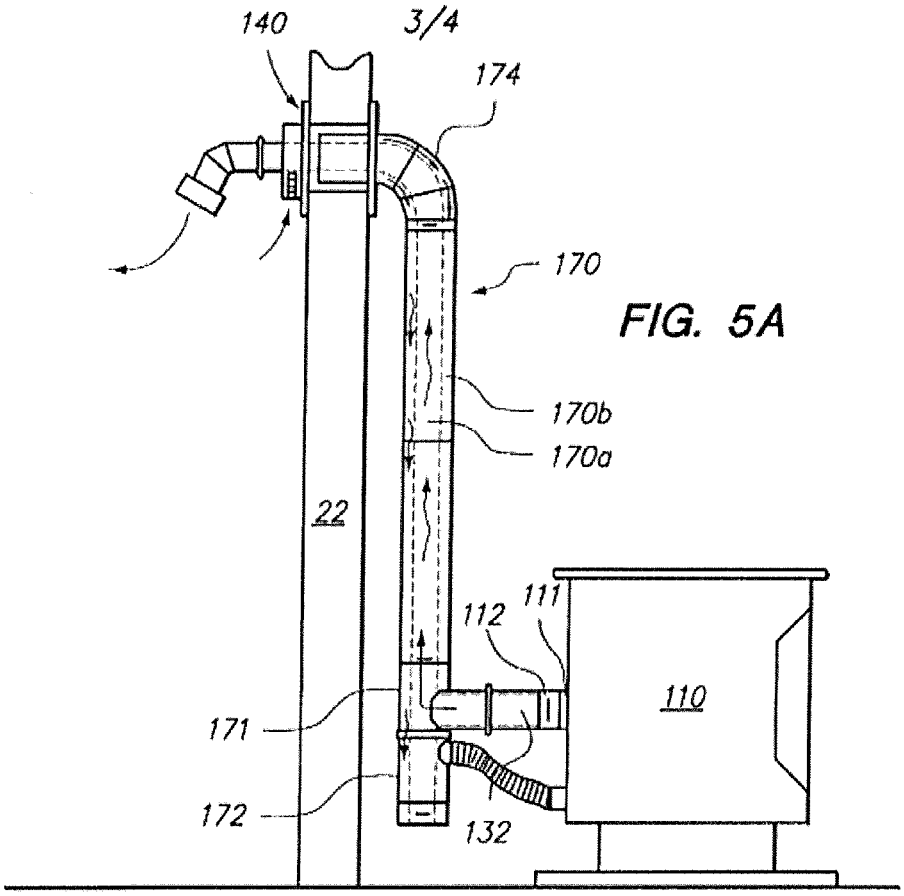
FIG. 5A is a side plan view of a second embodiment of a typical pellet stove installation including an exhaust/intake system.
Figure 5B:
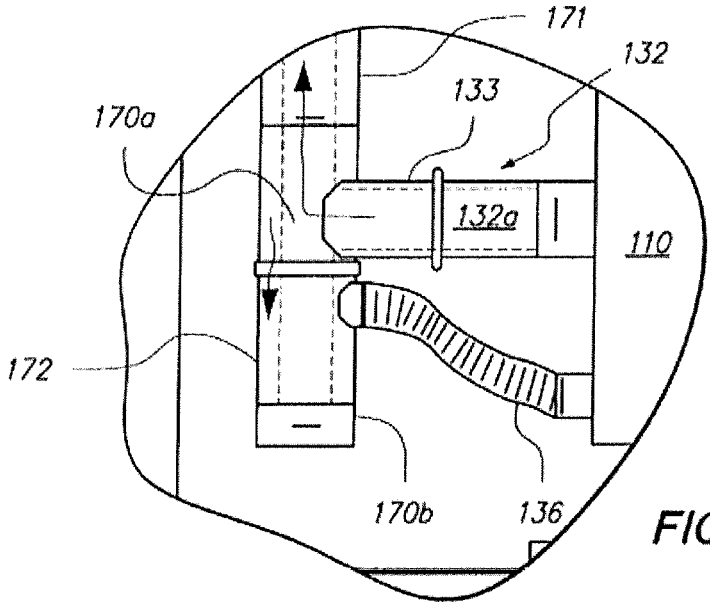
FIG. 5B is a magnified side plan view of a portion of FIG. 5A.

Another embodiment is shown in FIGS. 5A and 5B, wherein thimble 140 is mounted higher in side wall 22, thus requiring a section 170 of vertical pipe to couple the exhaust pipe 132 to the thimble. Materials and dimensions are consistent with those described above, but could be varied depending on the application. The vertical pipe section 170 is a larger diameter double-walled pipe than exhaust pipe 132. For example, in one typical embodiment, exhaust outlet in of stove 110 is a standard 3 inch diameter flue. A standard appliance adapter 112 (if necessary) couples exhaust pipe 132 to the flue in. Exhaust pipe 132 is a double-walled type PL pipe, wherein the inner pipe has a diameter of 3 inches and the outer wall has a diameter of 3.75 inches.

The vertical pipe section 170 is also a double-walled pipe, such as a standard stovepipe, having an outer wall diameter of approximately 6.625 inches and an inner pipe diameter of approximately 4 inches, although other sizes could be provided, such as 7 inches OD by 4 inches ID; 8 inches OD by 5 inches ID; and 8.625 inches OD by 5 inches ID. Referring to FIG. 5B, a standard single tee section 171 couples section 133 of exhaust pipe 132 to the vertical pipe 170. Note that the inner pipe 132*a* of exhaust pipe 132 is coupled to the inner pipe 170*a* of pipe 170. Another single tee section 172 couples a flexible air inlet hose 136 to the annular region 170*b* between the inner pipe and outer wall of pipe 170. An elbow 174 is coupled to the top of the vertical pipe 170 and to the wall thimble 140.

Figure 6:
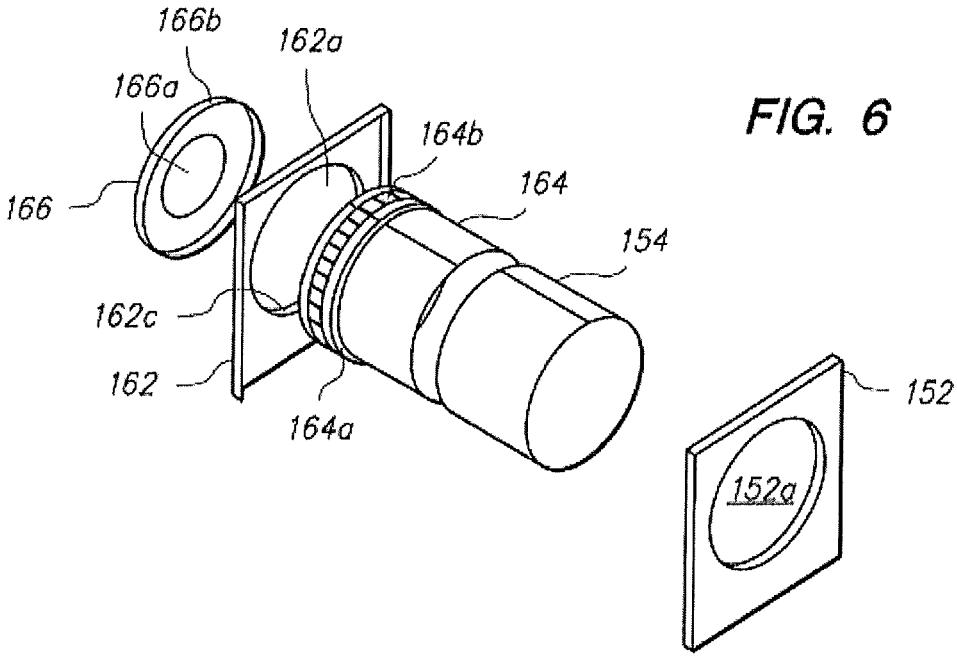
FIG. 6 is an exploded perspective view of the wall thimble shown in FIG. 5A.

As shown in FIG. 6, the thimble 140 is a two-part structure, namely inside housing portion 150 and outside housing portion 160. The inside housing portion 150 includes inside plate 152 and outer band 154. The inside housing portion 150 is assembled together by coupling the outer band 154 to the inside plate 152. This is done by fitting the end of outer band 154 over flange 152*a* of inside plate 152, then pop riveting these components together, for example, with four rivets spaced at 90 degrees.

The outside housing portion 160 includes outside plate 162, inner band 164, and outlet cap 166. A roll bead 164*a* and vent openings 164*b* are provided on one end of the inner band 164. The outside housing portion 160 is assembled together by coupling the outlet cap 166 and inner band 164 to the outside plate 162. The inner band 164 is fit through opening 162*a* in outside plate 162 until stopped by roll bead 164*a*, at which point the end of the inner band extends beyond the outside plate 162 by approximately 1½ inches such that vent openings 164*b* are exposed on the outside of wall 22. The flange 162*c* of outside plate 162 is attached to the inner band 164 using 6 resistance welds spaced at 60 degrees. The flange 166*b* of outlet cap 166 is fit over the end of inner band 164, and corresponding roll beads (not shown) are formed, then resistance welds are applied, for example, at 90 degrees spacing.

Figure 7:
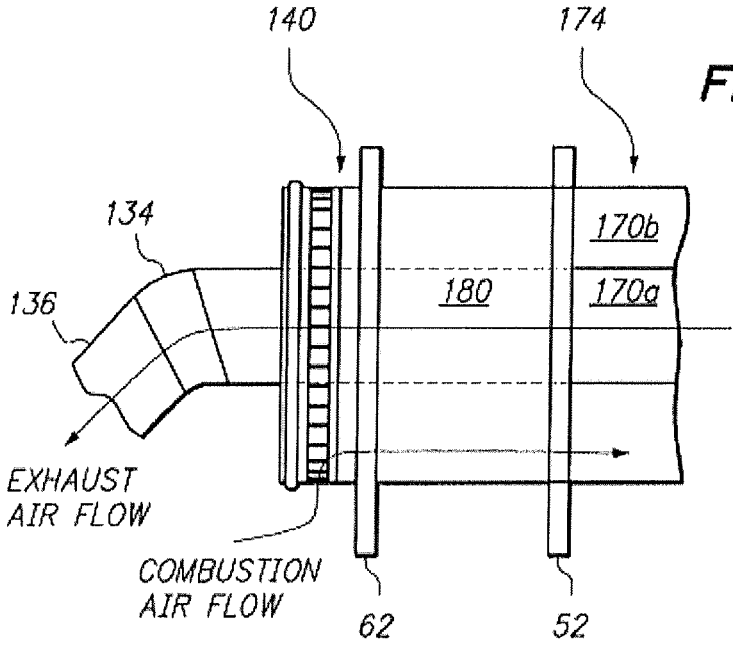
FIG. 7 is a magnified side plan view of a portion of FIG. 6.

The inside housing portion 150 and outside housing portion 160 are pre-assembled as described above, then installed in the field. For example, the elbow 174 is fitted into the opening 152*a* of inside plate 152 such that the outer wall of the elbow fits snugly within outer band 154. The joint is then sealed with a high temperature ceramic rope gasket and a liberal amount of RTV. As better shown in FIG. 7, a double-walled type PL pipe 180 is then routed through opening 166*a* of outlet cap 166 and coupled to the inner pipe 170*a*. The end of pipe 180 is coupled to elbow 134 and finally to horizontal cap 136. Thus, the double-walled vertical pipe 170 couples directly to the thimble and provides a first passageway 170*a* for venting exhaust by-products to the outside, and a second passageway 170*b* for drawing combustion air into the stove.

Referring to FIGS. 8A-8D, another embodiment of an exhaust/intake system 200 is illustrated schematically. This embodiment includes two additional features, namely, a thimble with internal baffles, and rigid extension sections for delivering combustion air to the heating appliance in a low grade or below grade installation. Materials and dimensions are consistent with the previously described embodiments, but could be varied based on the application.

Figure 8A:
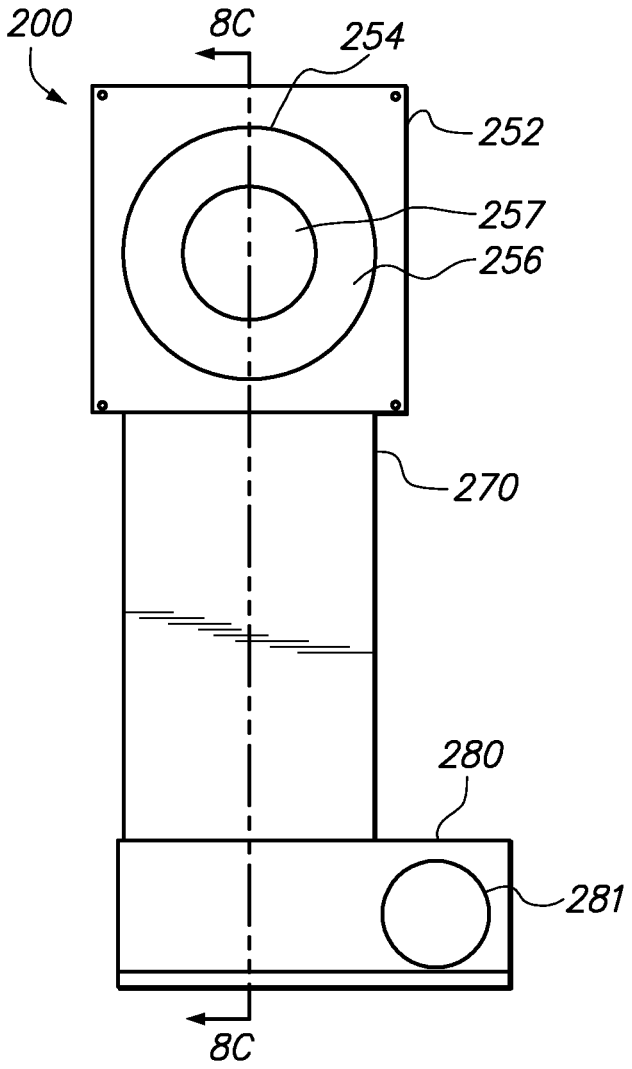
FIG. 8A is a front plan view of an alternative embodiment of an exhaust/intake system.

FIG. 8A shows a front plan view of system 200, i.e., as attached to a wall behind the heating appliance, including the interior cylinder section 254 of wall thimble 240 attached to the interior mounting plate 252, with vertical extension section 270 coupled to the interior mounting plate 252 and interior cylinder section 254, and exit section 280 coupled to the vertical extension section, as further described below.

Figure 8B:
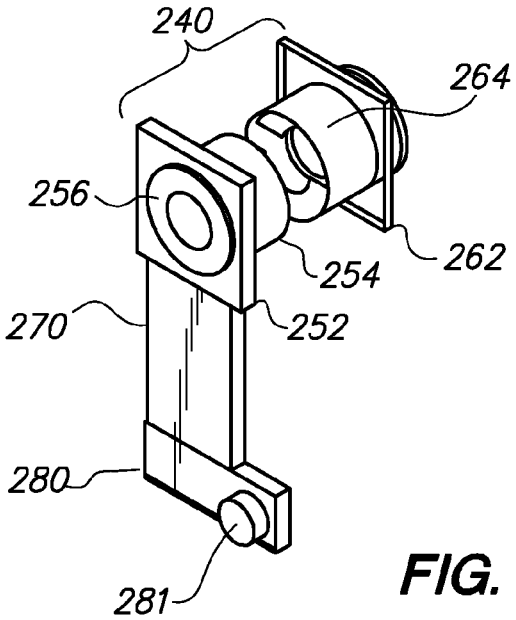
FIG. 8B is a perspective view of the system shown in FIG. 8A.
Figure 8C:
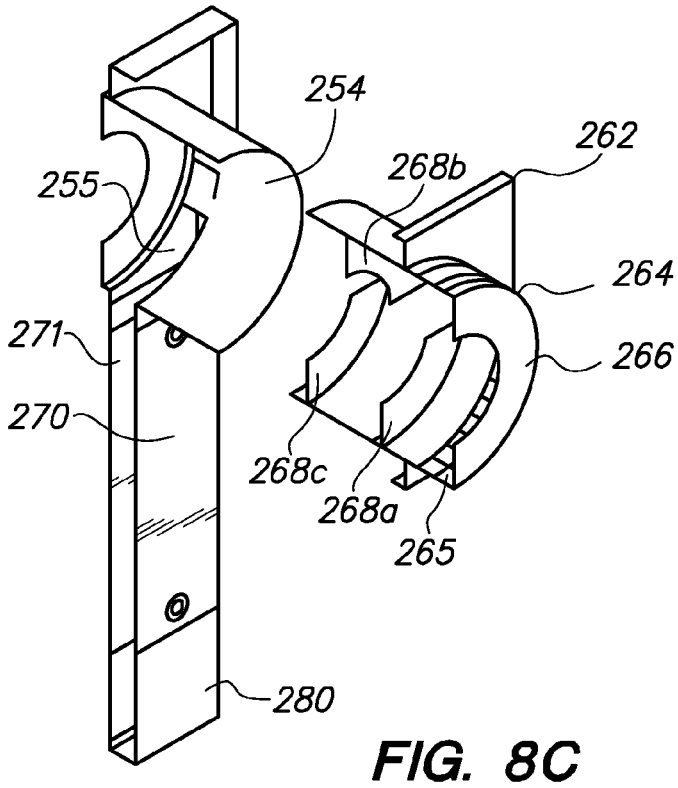
FIG. 8C is a perspective view taken across section C-C of FIG. 8B.
Figure 8D:
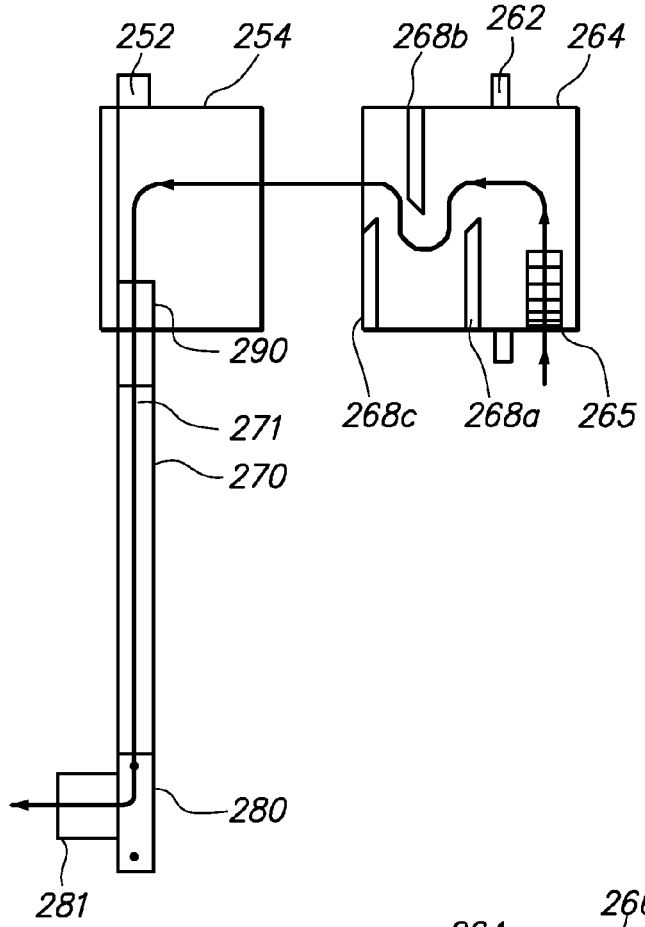
FIG. 8D is a side plan view taken of the system shown in FIG. 8A.

As shown in FIGS. 8B-8D, the wall thimble 240 is preferably formed as a two-part structure, namely the interior portion 254 and an exterior portion 264, each portion having a cover plate 256, 266, respectively. In a field installation, a wall opening is formed (not shown), and the interior mounting plate 252 is attached to the interior side of the wall opening, and the exterior mounting plate 262 is attached to the exterior side of the wall opening, for example, by nailing the mounting plates between wall studs. The mounting plates have central openings that must be coaxially aligned to receive the thimble parts. The interior portion 254 and exterior portion 264 are fitted together, then the interior portion is attached to the interior mounting plate 252, and the exterior portion 264 is attached to an exterior mounting plate 262, for example by welding or rivet.

The interior portion 254 and exterior portion 264 are both preferably formed as hollow cylindrical surfaces. The exterior portion 264 may be dimensioned slightly smaller in order to snugly insert into the interior portion 254 in mating correspondence. Alternatively, a recessed lip or other interlocking mechanism may be provided for mating the ends of the interior and exterior portions in well known manner. The heights of these cylindrical portions 254, 264 may be precut or field cut, but should be adequate to provide for some field adjustment to account for variations in wall thickness. Alternatively, a cylinder extension portion may be provided between the cylinder portions 254, 264, similar to portion 90 as shown in FIG. 3B.

The exterior cylinder portion 264 has an air intake vent 265 formed as a series of openings in the surface near the end of the cylinder. Note that the exterior cylinder portion 264 must be attached to the exterior mounting plate 262 such that the air intake vent 265 is positioned external to the structure so that outside air may be drawn in through the vent opening. The openings of the air intake vent 265 may extend around the entire circumference of the cylinder portion 264, but preferably, only a portion of the circumference will have the openings, namely, the downward facing surface.

The interior cylinder portion 254 also has an air intake vent 255 formed in the surface near the end of the cylinder, but on this end, the air intake vent is simply a radial section cut from the surface. Note that the interior cylinder portion 254 must be attached to the interior mounting plate 252 so that the interior air intake vent 255 is positioned inside of the mounting plate, in order to mate with a transition section 290.

Figure 9:
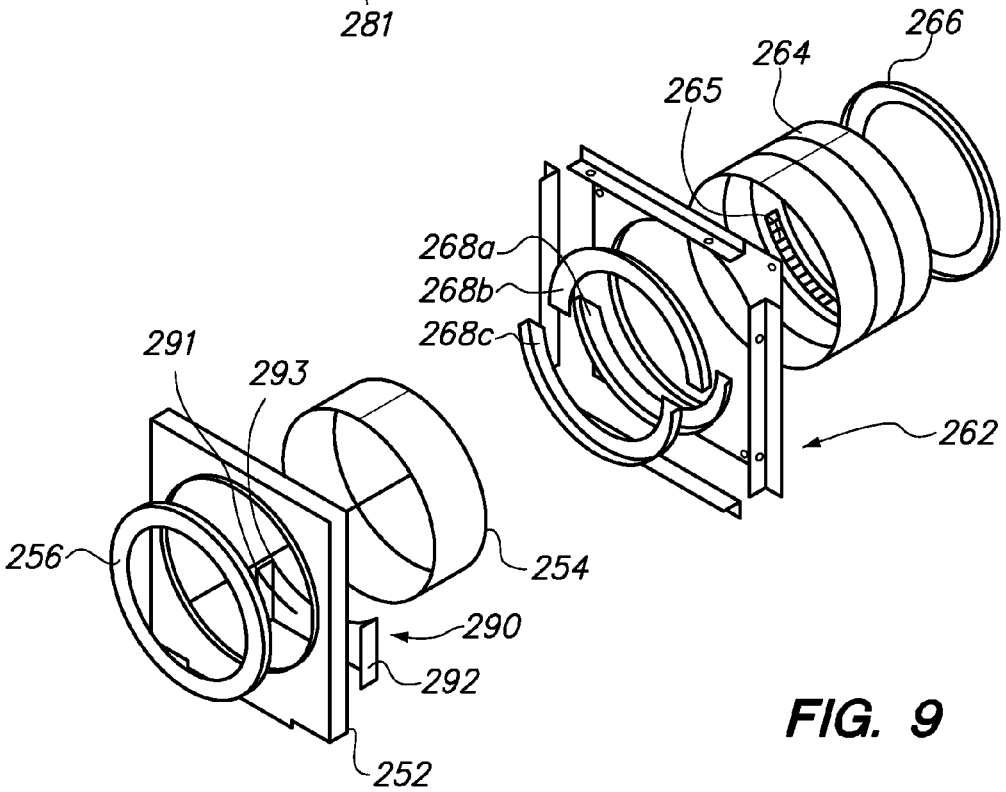
FIG. 9 is an exploded perspective view of the thimble shown in FIGS. 8A-8D.

FIG. 8C is a partial sectional view showing the interior construction of the exhaust/intake assembly 200, and FIG. 9 is an exploded view of the thimble 240. These figures illustrate baffles 268*a*, 268*b*, 269*c*, which are affixed to the interior surface of the exterior portion 264, for example, by spot welding or rivets. Each of the baffles is half of a ring-shaped annulus, and the central opening of the annulus defined by the baffles has a diameter that is smaller than the diameter of the central openings 257, 267 defined by the cover plates. Typically, a gap of ⅛ inch defines the difference between the diameters of the baffles and the cover plate openings. The baffles are offset by being alternately affixed to the bottom and top surfaces of the cylinder portion 264, for example. Thus, the first baffle 268*a* is affixed to the bottom surface spaced apart from the intake vent 265, the second baffle 268*b* is affixed to the top surface, i.e., 180 degrees offset from the first baffle, at a position that is spaced apart from the first baffle, and the third baffle 268*c* is affixed to the bottom surface, i.e., 180 degrees offset from the second baffle at a position that is spaced apart from the second baffle.

Transition section 290 is shown best in FIG. 9, and is no more than a small piece of sheet metal 291 having side arms 292 which are attached to the backside of the interior mounting plate 252, for example, by weld or rivet, to create an enclosed throughway for the combustion air from the thimble to the vertical extension section (or directly to the exit section). The sheet metal panel 291 has a radial cut 293 formed in correspondence with the radial cut air intake vent 255 on the interior cylinder section 254, and upon installation, the air intake vent is aligned to communicate with the enclosed throughway of the transition section 290. Further, the vertical extension section 270, or the exit section 280, is then coupled to the transition section 290.

In operation, combustion air flow is provided to the heating appliance by taking in ambient outside air through air intake vent 265 in the exterior cylinder portion 264, which flows through the baffles 268*a*, 268*b*, 268*c* and around the exhaust pipe (not shown), then into the interior cylinder portion 254, down through the air intake vent 255 into transition piece 290, then into the interior 271 of vertical section 270, then into exit section 280, through the flexible pipe (not shown) which couples the outlet 281 to the combustion air inlet of the heating appliance.

Figure 10A:
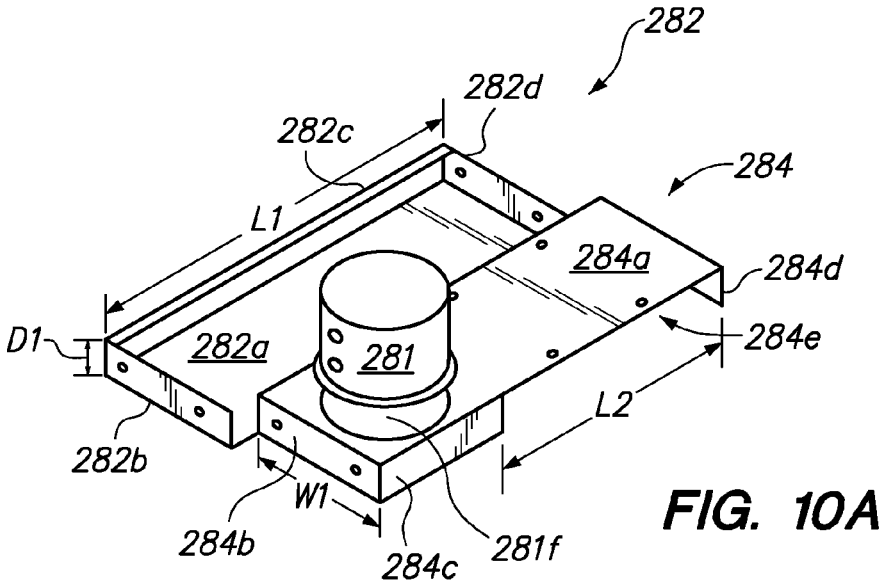
FIG. 10A is an exploded perspective view of the exit section shown in FIGS. 8A-8D.

Referring now to FIG. 10A, the exit section 280 is shown in more detail. The back section 282 is formed with a solid metal sheet 282*a* and three full sides 282*b*, 282*c*, 282*d*. The front section 284 is formed with a solid metal sheet 284*a* and two full sides 284*b*, 284*d*, a partial side 284*c* which defines an opening 284*e* on the same side, and an outlet opening 284*f*. An outlet coupling 281 is affixed into the outlet opening 284*f*. Typical approximate dimensions for the exit section 280 include a width W1 of 4 inches, a total length L1 of 11 inches, a vent opening length L2 of 7 inches, and a depth D1 of 1 inch.

Figure 10B:
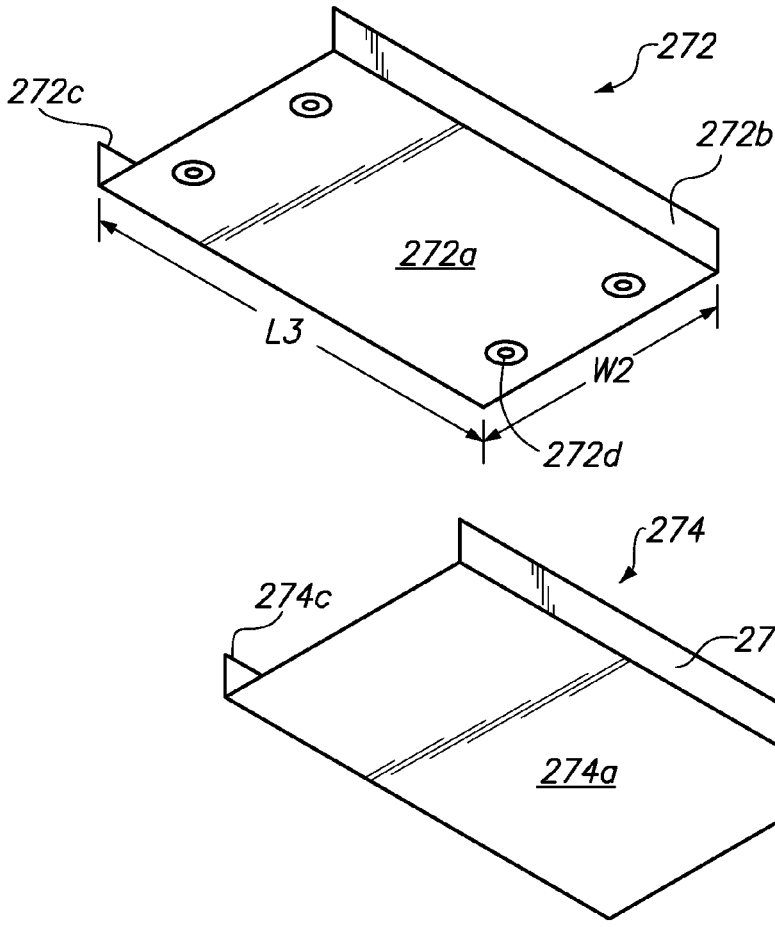
FIG. 10B is an exploded perspective view of the vertical section shown in FIGS. 8A-8D.
Figure 10C:
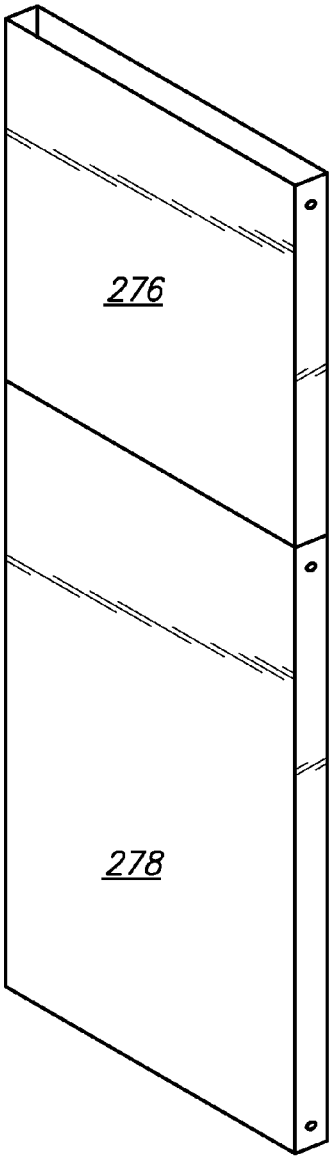
FIG. 10C is a perspective view of an alternative vertical telescoping section.
Figure 10D:
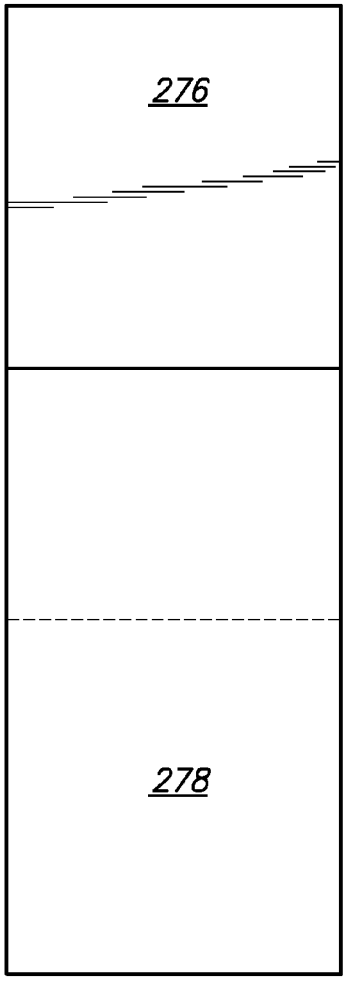
FIG. 10D is a front plan view of the alternative vertical telescoping section shown in FIG. 10C.

Referring to FIG. 10B, the back 272 of vertical section 270 is formed with a solid metal sheet 272*a* having two longs sides 272*b*, 272*c*, and mounting sites 272*d* for mounting the section to the interior wall, for example, with mechanical fasteners. The front 274 of vertical section 270 is formed with a solid metal sheet 274*a* having two longs sides 274*b*, 274*c*. Typical approximate dimensions for the vertical section 270 include a width W2 of 7 inches, a total length L3 of 12 inches, and a depth D2 (when installed) of 1 inch. However, the total length of the vertical section 270 may be varied depending upon the installation. For example, lengths up to 36 inches may be required for some installations. Further, in order to provide easy field adjustability, the vertical section 270 may be formed as a pair of telescoping panels 276, 278, as shown in FIGS. 10C and 10D. Panels 276 and 278 are formed as described above, except that panel 276 is slightly smaller than panel 278. Thus, panel 276 fits snugly within panel 278, and the panels are sized to provide significant vertical adjustment in a telescoping manner, as shown by the dashed lines in FIG. 10D. For example, the telescoping panels 276, 278 may provide a range of field adjustment from 1 to 36 inches. Since the intake air is under negative pressure, sealing the telescoping panels is not needed, but could be provided with RTV sealant, for example.

Figure 11A:
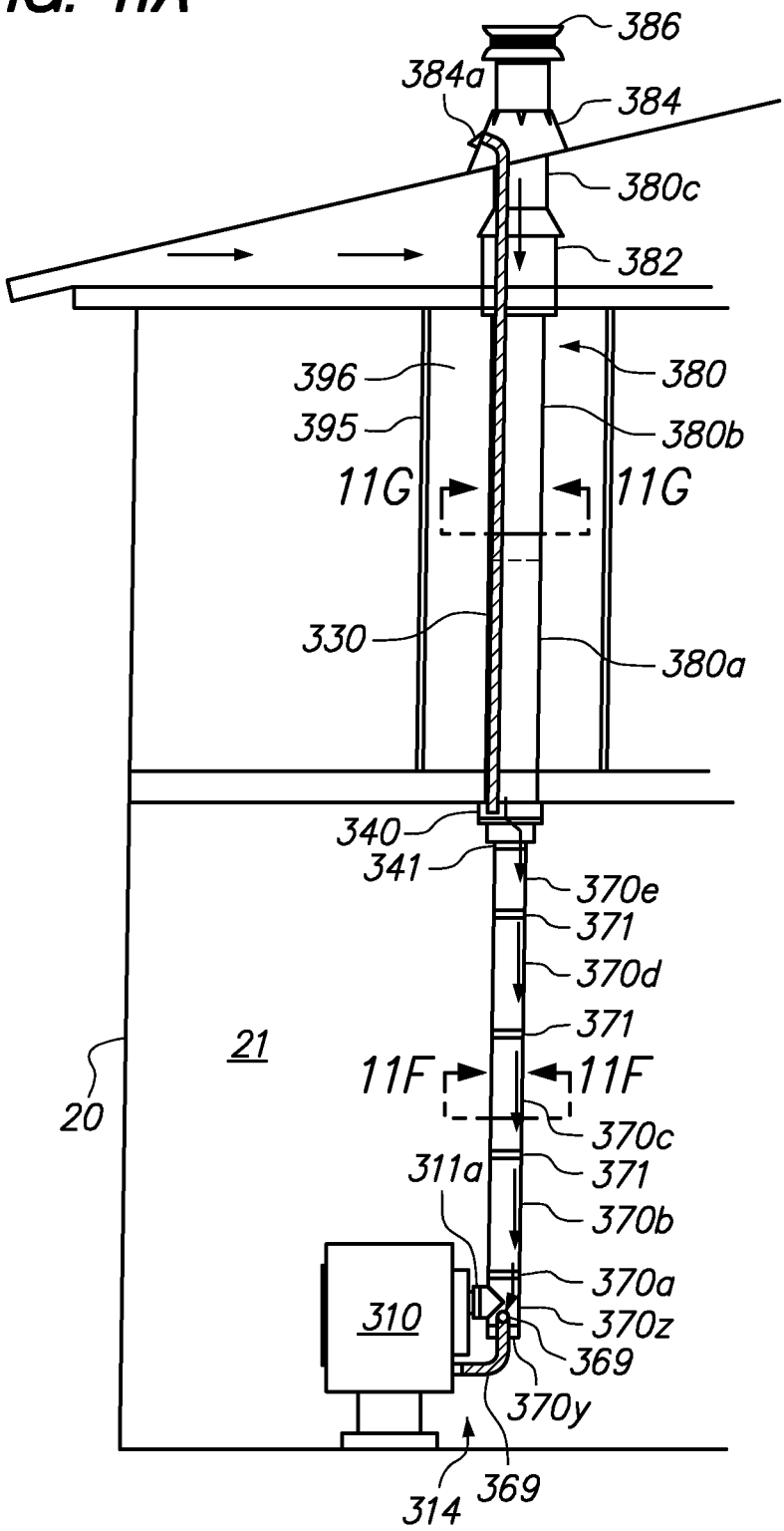
FIG. 11A is a side plan view of a heating appliance having a rear exit exhaust flue connected to a chimney system with an integrated intake/exhaust system.
Figure 12B:
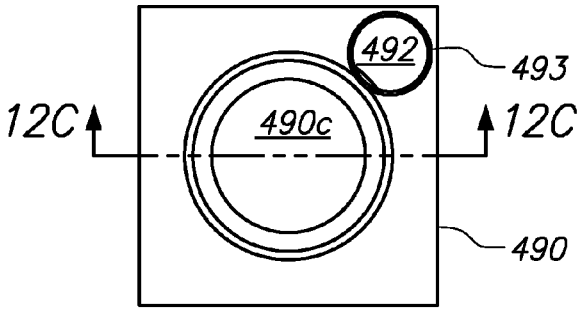
FIG. 12B is a top plan view of the ceiling interface/support box shown in FIG. 12A.
Figure 12A:
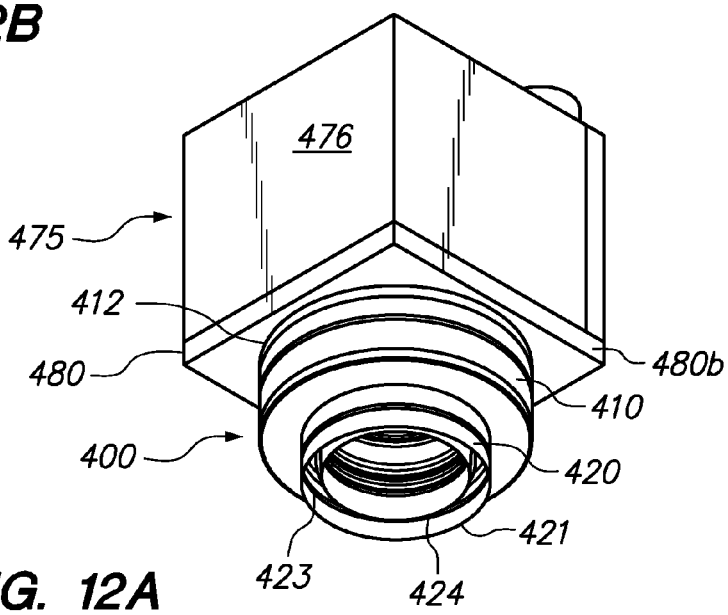
FIG. 12A is a perspective view of a ceiling interface/support box.

Referring now to FIG. 11A, a heating appliance exhaust system with an integrated combustion air intake is illustrated. The heating appliance 310 is located in a room 21 inside structure 20, and a stove pipe 370 couples the heating appliance to an interface box 340 located at the ceiling of the room. A chimney pipe 380 is coupled between the interface box 340 and the outlet and is contained with a chase structure 395. It is noted that the Figures are not dimensionally accurate; for example, the chase structure 395 would typically be formed to mate with the box frame portion 475 (shown in FIG. 12A).

The illustrated embodiment includes a rear exit exhaust flue 311*a* and combustion air inlet 314. Another embodiment showing a top exit exhaust flue 311*b* is shown in FIG. 11E. A t-section 370*a* is coupled to the rear exhaust flue 311*a*, which may require a standard appliance adapter (not shown). The t-section 370*a* preferably includes a cap 370*y* for easy cleaning and inspection that includes a nipple 369 for attaching a flex pipe 336, and may include an internal damper 370*z* for flow adjustment.

The stove pipe 370 is coupled in sections to the t-section 370*a*, for example, stove pipe section 370*b* is coupled to the t-section 570*a*; stove pipe section 370*c* is coupled to stove pipe section 370*b*; stove pipe section 370*d* is coupled to stove pipe section 370*c*; and stove pipe section 370*e* is coupled to stove pipe section 370*d*. Stove pipe section 370*e* is coupled at the ceiling to ceiling support box 340, which is affixed to structural members in well-known manner. The ceiling support box 340 is analogous to the "thimble" described previously and is the structural interface in this embodiment. All couplings include well-known slip connections and are attached with screws, for example. Stove pipe sections 370 are typically provided in one or more standard lengths, such as 3 feet. Further, each of the stove pipe sections 370 are at least double-walled pipes having an inner wall and an outer wall, similar to the DVL® stove pipe sold by Simpson Dura-Vent Co. of Vacaville, Calif. In a preferred embodiment, each of the stove pipe sections 370 is a triple-walled pipe having inner wall 372*a*, a middle wall 372*b*, and an outer wall 372*c*, as shown in FIG. 11F. The inner wall 372*a* contains the exhaust gases. The combustion air is transported in a ½ inch annular space 374 between the outer wall 372*c* and the middle wall 372*b*. The middle wall 372*b* acts as an insulation barrier with a ¼ inch annular space between the middle wall and the inner wall 372*a*, and is preferably empty air space, but could be filled with an insulating material, such as ceramic fiber or mineral wool insulation. This insulation barrier helps keep the exhaust gases hot and prevents over-cooling of the exhaust gases and the corresponding production of creosote caused thereby.

A chimney pipe 380 is coupled in sections to the ceiling support box 340, for example, a first section 380*a* of chimney pipe is coupled to the ceiling support box 340, a second section 380*b* of chimney pipe is coupled to the first section 380*a*, and a third section 380*c* of chimney pipe is coupled to the second section 380*b*. All couplings include well-known twist-lock connections formed as an integral part of one end of the chimney pipe. Chimney pipe section 380*c* is routed through an insulation shield 382, which is affixed between the ceiling and attic space in well-known manner, for example, between wall joists. The chimney pipe 380*c* exits through a roof opening, which is suitably flashed and sealed, and through a storm collar 384, finally terminating with a chimney cap 386.

Figure 11B:
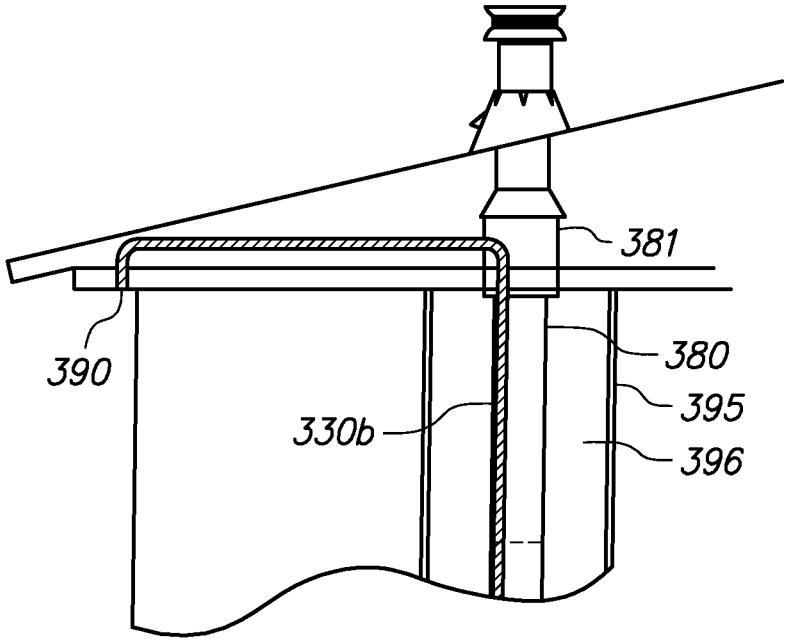
FIG. 11B is a partial side plan view of the heating appliance of FIG. 11A with an alternative air inlet arrangement.
Figure 11C:
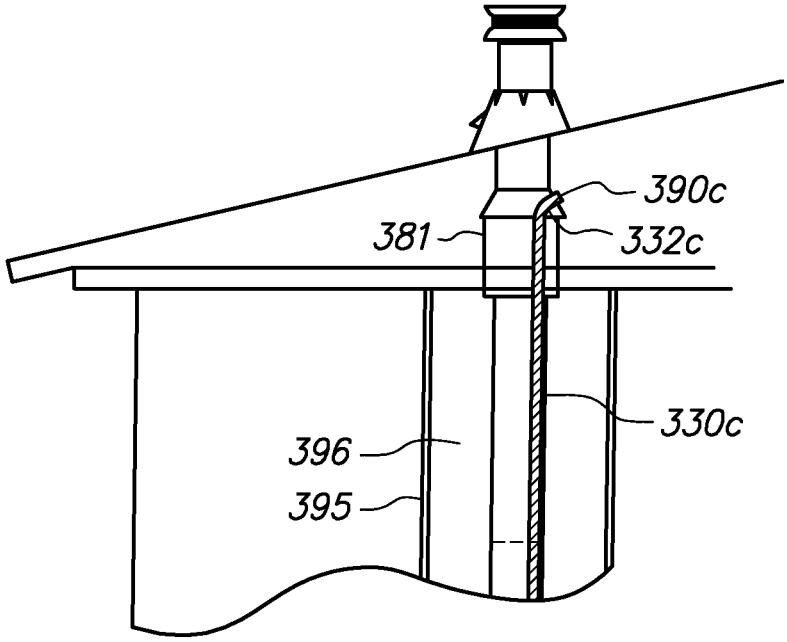
FIG. 11C is a partial side plan view of the heating appliance of FIG. 11A with another alternative air inlet arrangement.
Figure 11D:
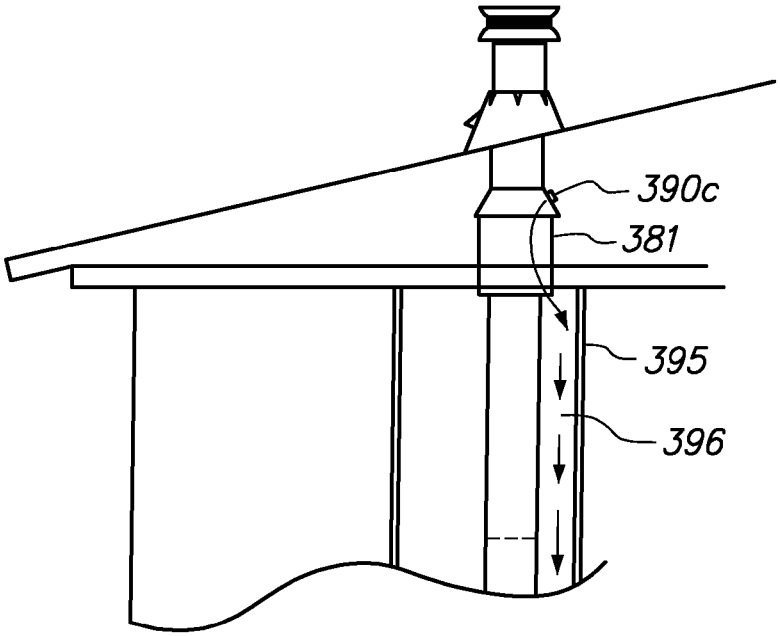
FIG. 11D is a partial side plan view of the heating appliance of FIG. 11A with yet another alternative air inlet arrangement.
Figure 11E:
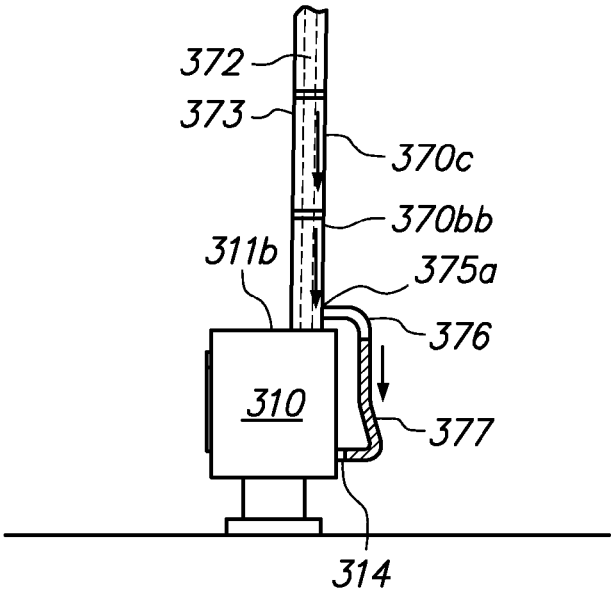
FIG. 11E is a partial side plan view of a heating appliance having a top exit exhaust flue connected to a chimney system with an integrated intake/exhaust system.
Figure 11F:
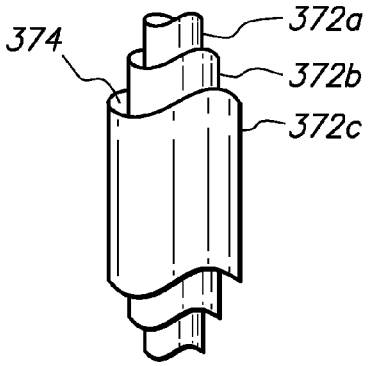
FIG. 11F is a partial perspective view of the stove pipe taken across section F-F of FIG. 11A.
Figure 11G:
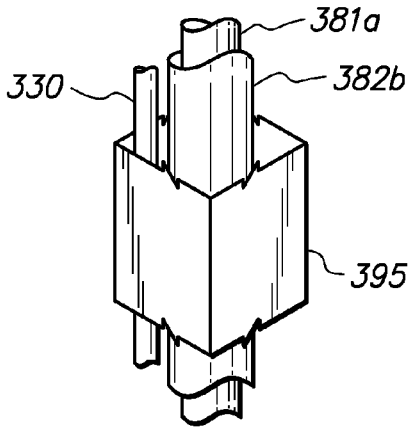
FIG. 11G is a partial perspective view of the chimney pipe taken across section G-G of FIG. 11A.

Each of the chimney pipe sections 380 is preferably at least a double-walled structure having an inner wall 381*a* and an outer wall 381*b*, as shown in FIG. 11G. For example, Dura-Plus® chimney pipe sold by Simpson Dura-Vent Co., is actually a triple wall product, having an outer wall, an intermediate wall, and an inner liner.

The chase structure 395 is typically built in the field to surround the chimney 380 thereby creating an annular space 396 between the chimney and the walls of the chase structure. Combustion air taken from outside the eave or the roof or from within the attic space is routed through the annular space 396 in the chase structure 395 into the support box 340.

In one embodiment, a combustion air pipe 330 is installed to run from the ceiling support box 340 up through the roof to an air intake opening 384*a* in the flashing or storm collar 384. The combustion air pipe 330 is preferably a flexible pipe, such as DuraFlex® pipe sold by Simpson Dura-Vent Co. Further, the combustion air pipe 330 may run adjacent to the chimney pipe within the annular space 396 of the chase portion 395 and be secured by one or more straps (not shown) to the chimney pipe sections.

In another embodiment shown in FIG. 11B, an intake opening 390 is provided in the eaves under the roof, and the combustion air pipe 330*b* is run through the annular space 396 in chase structure 395 into the insulation shield 382 and out through the attic to the intake opening.

Another variation is shown in FIG. 11C, where the air intake opening 390*c* is formed in the insulation shield 382, and the combustion air pipe 330*c* is run through the annular space 396 in chase structure 395 and into the insulation shield to the intake opening.

Yet another embodiment is shown in FIG. 11D, where the air intake opening 390*c* is formed in the insulation shield 382 as in FIG. 11C, but there is no combustion air pipe. Instead, the combustion air is transported down through the annular space 396 next to the chimney pipe created by the chase structure 395 that contains the chimney pipe.

At the other end of the system, a flexible pipe 336 is coupled from the combustion air inlet 314 to a nipple 369 in t-section 370*a*The nipple 369 couples the flex pipe 336 to the annular region 374 between the outer wall 372*c* and middle wall 373*b* of the stove pipe 370.

As noted above, FIG. 11E shows a chimney system similar to that shown in FIG. 11A, except that the heating appliance 310 has a top exit exhaust flue 311*b*. Thus, instead of t-section 570*a*, this embodiment includes stove pipe section 370*bb*, which is coupled directly to exhaust flue 311*b* using an appropriate adaptor (not shown). Further, section 370*bb* includes an outlet 375*a* which is coupled to the outer wall 373 of stove pipe 370*bb*. A solid elbow 376 is coupled to the outlet 375*a*, and a length of flexible pipe 377 is coupled between the elbow and the combustion air inlet 314. In all other respects, the configuration is the same as in FIG. 11A.

Referring now to FIGS. 12-13, the ceiling support box 340 is illustrated in more detail. In FIG. 12A, the support box 340 is shown in perspective, and may be generally described as having a collar portion 400 and a box frame portion 475.

The box frame portion 475 is preferably formed as a square structure, but it could other shapes, such as cylindrical. Further, the box frame portion 475 typically forms the bottom portion of a chase structure which encloses the chimney pipe 380 from the support box 340 to the insulation shield 382, and creates a space between the chimney pipe and the walls 476 of box frame 475. The space may be used to transport combustion air in the box frame portion 475 next to the chimney to the support box 340, and into the corresponding annular space 374 in the stove pipe 370. The box frame portion 475 is attached to one or more structural members, e.g. to wall joists, by well-known mechanical means, such as screws, nails, or support straps.

The collar portion 400 includes a support box collar portion 410 and a stove pipe collar portion 420.

Figure 12C:
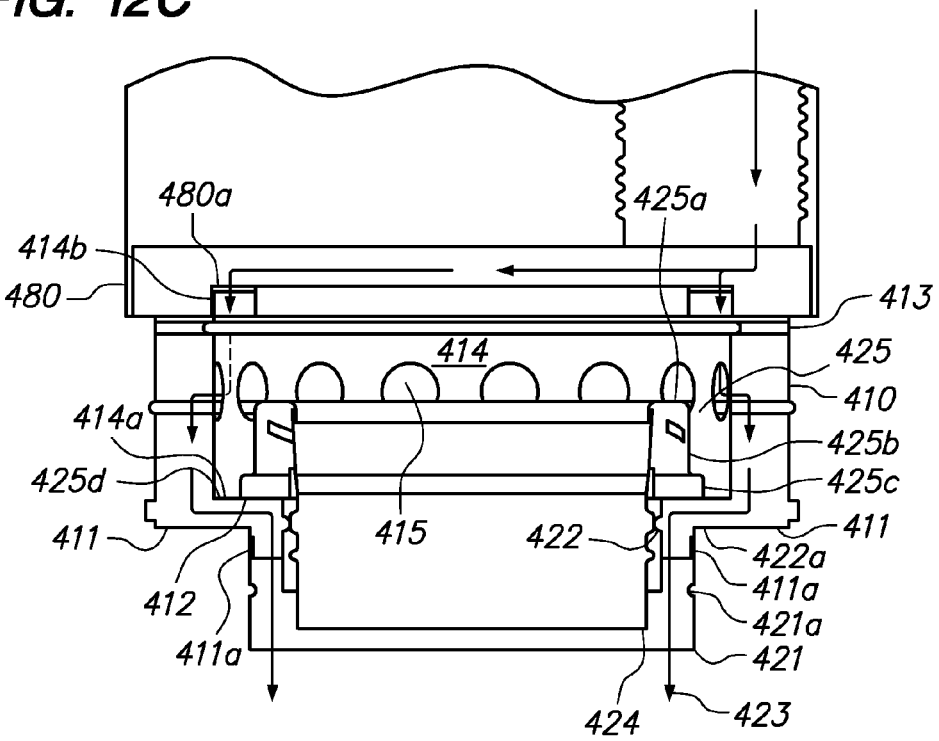
FIG. 12C is a side plan view of the ceiling interface/support box shown in FIG. 12A taken across the section 12C-12C shown in FIG. 12B.

The stove pipe collar portion 420 is adapted to couple with the stove pipe 370, and includes a first or outer stove pipe wall 421, a second or intermediate stove pipe wall 422, and an inner stove pipe wall 424 (better seen in FIG. 12C). An annular space 423 is created between the intermediate wall 422 and the outer wall 421. The annular space 423 of the stove pipe collar portion 420 is used to transport combustion air to the heating appliance via the annular space 374 of stove pipe 370, as described more fully below.

The outer stove pipe wall 421 is a piece of 0.018 inch zinc-plated galvanized steel plate or other suitable material which is cold-rolled into a generally cylindrical, hollow section approximately 2 inches long, with a roll bead 421*a* formed around the center, then riveted or welded at the seam to create an outside diameter measuring approximately 7.5 inches. The outer wall 421 is riveted or welded onto a lip 411*a* of flange 411.

The intermediate stove pipe wall 422 is also a piece of cold-rolled 0.018 inch zinc-plated galvanized steel plate or other suitable material. However, this cylindrical, hollow section is only approximately 1 inch long, but again, there is a roll bead 422*a* formed around the center, and the section is riveted or welded at the seam to create an outside diameter measuring approximately 6.5 inches. The intermediate wall 422 is riveted or welded together with the inner wall 424, which may also be considered the exhaust duct 424.

The inner wall or exhaust duct 424 is formed as a cylindrical hollow section using 0.012 inch type 430 stainless steel, is approximately 6 inches in diameter by 4 inches long, and includes roll beads 424*a* and 424*b*. The seam is folded over and riveted or welded.

On the inside end of the exhaust duct 424, i.e., inside the support box collar portion 410, another piece of stainless steel is formed as a collar 425 with a top portion 425*a* folded over the top of the duct 424 and welded or riveted to the duct to create a lip approximately ⅝ inch wide. Further, the collar 425 includes a collar wall 425*b* extending approximately 1.25 inches, a flange portion 425*c* at the end of the collar wall, and finally, a rim portion 425*d* that is welded or riveted onto flange 412. Of course, variations in the design and shape of the chimney pipe would dictate the design and shape of the collar 425.

A vent collar 414 is formed from cold-rolled 0.018 inch zinc-plated galvanized steel plate or other suitable material into a cylindrical, hollow section with circular vent openings 415. A perpendicular lip 414*a* at the bottom of the vent collar 414 is welded or riveted together with the rim portion 425*d* of collar 425. Further, a vertical lip 414*b* at the top of the vent collar 414 is welded or riveted to a corresponding lip 480*a* on frame portion 480. The support box collar 410 is also formed from cold-rolled 0.018 inch zinc-plated galvanized steel plate or other suitable material into a cylindrical, hollow section measuring approximately 11 inches in diameter and 3.6 inches in height, and is welded or riveted to frame portion 480, for example, via lip 413. The flange 411 is welded to the bottom of the chase portion and includes an opening measuring approximately 7.5 inches in diameter, i.e., the same as the outer stove pipe wall 421.

The frame portion 480 is also formed of galvanized steel plate as a 12 inch by 12 inch square having a central opening 480*c* approximately 9 inches in diameter. The frame 480 includes a vertical annular lip 480*a*, as noted above, where the vent collar 414 is affixed. Further, the frame 480 includes a raised lip 480*b* (approximately 1 inch in height) on all four sides, and the four walls 476 of chase structure 475 are welded or riveted to the corresponding raised lip portion.

A frame insert portion 490 is formed of galvanized steel plate as a slightly smaller square than the frame 480 but with a corresponding central opening 490*c* that is also slightly smaller than opening 480*c*. For example, the frame insert portion 490 may be formed to be 11.8 inches square so that it inserts into the frame portion 480. The frame insert portion 490 includes a raised lip 490*b* (approximately 1 inch in height) on all four sides. In use, the frame insert portion 490 is thus inverted and placed against the frame portion 480 so that an air space is created between the frame insert portion and the frame portion. A combustion air opening 492 with a diameter of approximately 3.020 inches is formed in the frame insert portion 490 offset from the central opening 490*c*. Further, a neck 493 measuring about 2 inches high is affixed to the combustion air opening 492 and extends into the chase portion 475 to provide an attachment point for a combustion air pipe (flex or solid).

Figure 12D:
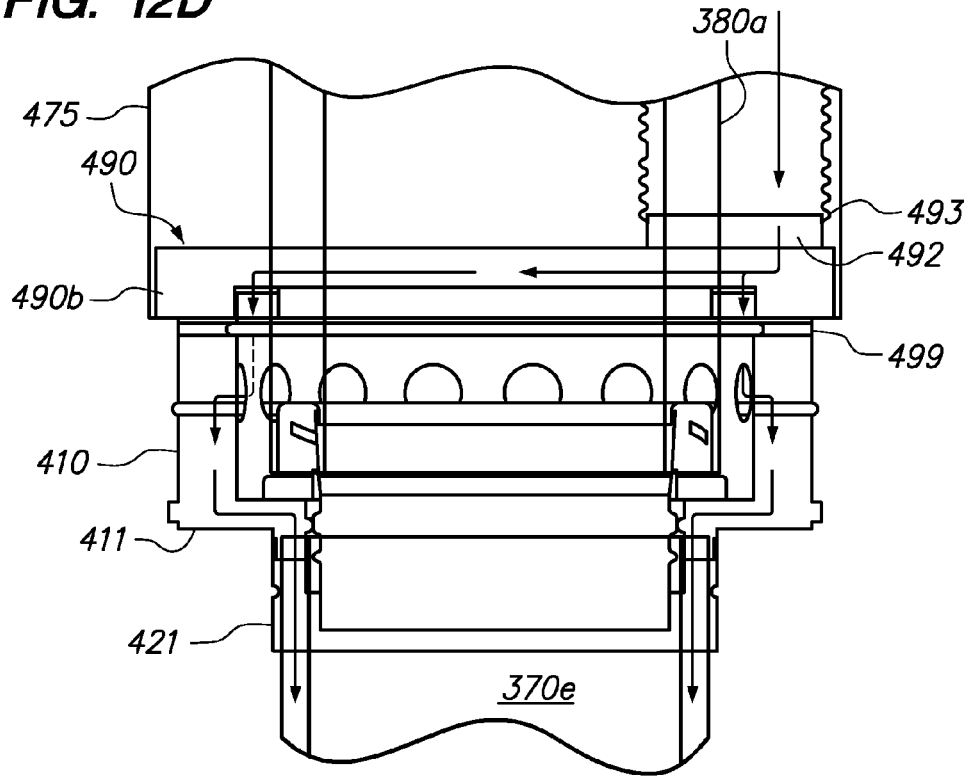
FIG. 12D is a side plan view similar to FIG. 12C which shows the connection of chimney pipe and stove pipe to the ceiling interface/support box.

In use, the interface structure 340 is fixed in place at the ceiling, as shown schematically in FIG. 11A. As shown in FIG. 12D, chimney pipe 380*a* is terminated into the structure from the top such that an annular space 499 is created between the chimney pipe and the vent holes 415 in the vent collar 414. Further, stove pipe 370*e* is terminated into the structure from the bottom such that the annular space 374 between the outer wall 372*c* and the intermediate wall 372*b* communicates with the air space created between the support box wall 410 and the vent collar 414.

Thus, as seen in FIG. 12D, combustion air is delivered through a flex pipe 330 (or alternatively, through the chase structure containing the chimney pipe) through neck 493 into opening 492. At that point, the combustion air circulates under frame insert portion 490 and down into the gap between the chimney pipe 380*a* and vent collar 414. The combustion air continues to flow out the vent holes 415 and into the gap between the vent collar 414 and the support box collar 410, then down between collar 425 and flange 411 into the annular space 423 between the inner and outer stove walls. The annular space thus communicates with the annular space 374 of the stove pipes, and the combustion air flows to air inlet 314, as shown in FIG. 11A.

Thus, it can be seen that the exhaust gases have a direct path through the center of the interface structure, while the combustion air has a separate path defined by annular spaces created in the interface structure.

The foregoing detailed description has been presented for purposes of illustration and description. It is not intended to be exhaustive or limiting to the precise form disclosed. Many modifications and variations are possible in light of the above teachings. For example, common variations in dimensions, structures and materials exist, and suitable modifications to accommodate such different dimensions, structures and materials could readily be made. The described embodiments were chosen in order to best explain the principles of the disclosure and its practical application to thereby enable others skilled in the art to best utilize the disclosure in various embodiments and with various modifications as are suited to the particular use contemplated. It is intended that the scope of the invention be defined by the claims appended hereto.

We claim:

1. An interface structure coupling a first pipe with a second pipe at an interface as part of an exhaust/intake system used with a heating appliance, wherein at least the first pipe includes an outer wall, an inner wall, and a first annular space defined between the outer wall and the inner wall, comprising:

a frame having a central circular opening;

a frame insert placed on the frame from above and having a first circular opening corresponding with the central circular opening of the frame, a vent opening offset from the first circular opening, and a raised lip that creates a space between the frame and the frame insert;

a cylindrical vent collar having a top portion affixed to the frame at the central circular opening and extending a first height below the frame, with a first annular flange affixed to the vent collar at a bottom portion thereof, the first annular flange having a second circular opening;

a cylindrical chase collar having a top portion affixed to the frame and extending a second height below the frame, the second height being larger than the first height, with a second annular flange affixed to the chase collar at a bottom portion thereof, the second annular flange having a third circular opening larger than the second circular opening;

a cylindrical exhaust duct coupled to the annular flange of the vent collar and having a diameter corresponding with the second circular opening;

the first pipe capable of coupling to the first annular flange of the vent collar and having a diameter slightly larger than the second circular opening and the outer wall thereof capable of coupling the second pipe capable of coupling to the second annular flange of the chase collar and having a diameter corresponding with the third circular opening.

2. The structure of claim 1 wherein the central circular opening, the second circular opening and the cylindrical exhaust duct align such that the first pipe coupled to the vent collar aligns with the exhaust duct and the second pipe.

3. The structure of claim 2 wherein the vent collar includes an annular wall separating a combustion flow path from the vent opening to an annular region between the inside stove pipe and the outside stove pipe, and wherein combustion air is drawn through the vent opening into the annular region.

4. The wall thimble of claim 3, wherein the annular wall includes a plurality of air vents formed as a series of openings arranged around a circumference of corresponding cylinder portions.

5. The wall thimble of claim 4, wherein at least one of the air vents is formed as a series of openings arranged around a portion of the circumference of the corresponding cylinder portion.

6. An ceiling support box coupling a first pipe to an inlet/exhaust a second pipe at an interface as part of an exhaust/intake system used with a heating appliance, wherein at least the first pipe includes an outer wall, an inner wall, and a first annular space defined between the outer wall and the inner wall, comprising:

a frame (480) having a central circular opening formed in frame member having a top surface and a bottom surface;

a frame insert (490) on the top surface and having a first circular opening corresponding with the central circular opening, an intake vent opening offset from the first circular opening, and a raised lip (490(*b*)) that creates a space between the frame and the frame insert;

a cylindrical vent collar (414) having a top portion affixed to the frame at the central circular opening and extending a first height below the frame, with a first annular flange (414*a*) affixed to the vent collar at a bottom portion thereof, the first annular flange having a second circular opening;

a cylindrical chase collar (410) having a top portion affixed to the frame and extending a second height below the frame and surrounding the vent collar, the second height being larger than the first height, with a second annular flange (411) affixed to the chase collar at a bottom portion thereof, the second annular flange having a third circular opening larger than the second circular opening;

a cylindrical exhaust duct (424) coupled to the first annular flange (414*a*) of the vent collar and having a diameter corresponding with the second circular opening;

the first pipe (370*e*) capable of coupling to the exhaust duct such that the inner wall thereof engages the first annular flange (424) of the vent collar and having a diameter slightly larger than the second circular opening, and the outer wall thereof capable of coupling to the second annular flange (421) of the chase collar and having a diameter corresponding with the third circular opening.

7. The structure of claim 6 wherein the second pipe (380*a*) capable of coupling to the second annular flange (411) of the chase collar and having a diameter corresponding with the third circular opening.

8. The structure of claim 7 wherein the central circular opening, the second circular opening and the cylindrical exhaust duct align such that the first pipe coupled to the vent collar aligns with the exhaust duct and the second pipe.

9. The structure of claim 8 wherein the vent collar includes an annular wall separating a combustion flow path from the vent opening to an annular region between the inside stove pipe and the outside stove pipe, and wherein combustion air is drawn through the vent opening into the annular region.

10. The wall thimble of claim 9, wherein the annular wall includes a plurality of air vents formed as a series of openings arranged around a circumference of corresponding cylinder portions.

11. The wall thimble of claim 9, wherein at least one of the air vents is formed as a series of openings arranged around a portion of the circumference of the corresponding cylinder portion.

12. An structure coupling a stove pipe with a chimney pipe at an interface as part of an exhaust/intake system used with a heating appliance, wherein at least the stove pipe includes an outer wall, an inner wall, and a first annular space defined between the outer wall and the inner wall, comprising:

a frame insert (490) engaging a frame, the frame housing the chimney pipe to exhaust the heating appliance through a first circular opening, the insert including a vent opening offset from the first circular opening;

a stove pipe collar (420) adapted to couple with the stove pipe, the stove pipe collar having an outer stove pipe wall (421) and an inner stove pipe wall (424) with an annular space created between the inner wall and the outer wall to transport combustion air to a heating appliance from the vent opening, the outer stove pipe wall capable of engaging the outer wall of the stove pipe and the inner stove pipe wall capable of engaging an inner wall of the stove pipe, the inner stove pipe wall (424) coupled to the annular flange (411) and having a diameter corresponding with the second circular opening;

a support box collar (410) surrounding the stove pipe collar (420) and forming an annular pathway therein between, the annular pathway forming a combustion air path between the vent opening and the first annular path between the inner and outer wall of the stove pipe; and wherein the structure is affixed in a support box such that the first circular opening is aligned with the chimney pipe and the stove pipe.

* * * * *